US008041263B2

(12) United States Patent
Tanaka et al.

(10) Patent No.: US 8,041,263 B2
(45) Date of Patent: Oct. 18, 2011

(54) CHARGING DEVICE

(75) Inventors: Arichika Tanaka, Kanagawa (JP); Toshiyuki Matsui, Kanagawa (JP); Shigeo Ohno, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 94 days.

(21) Appl. No.: 12/550,652

(22) Filed: Aug. 31, 2009

(65) Prior Publication Data

US 2010/0196051 A1 Aug. 5, 2010

(30) Foreign Application Priority Data

Feb. 3, 2009 (JP) ..... P2009-022860

(51) Int. Cl.
*G03G 15/00* (2006.01)

(52) U.S. Cl. ..... 399/171

(58) Field of Classification Search ..... 399/170, 399/171, 172; 250/324, 325
See application file for complete search history.

(56) References Cited

U.S. PATENT DOCUMENTS 6,393,237 B1 * 5/2002 Shindo ..... 399/171
6,823,157 B2 * 11/2004 Foltz ..... 399/171
6,917,773 B2 * 7/2005 Maeda et al. ..... 250/324 X
6,944,413 B2 * 9/2005 Maeda ..... 399/170 X
7,016,628 B2 * 3/2006 Maeda et al. ..... 399/171
7,174,114 B2 * 2/2007 Gila et al. ..... 399/170 X

FOREIGN PATENT DOCUMENTS

JP A-06-289692 10/1994
JP A-08-286471 11/1996
JP 10-142900 * 5/1998

* cited by examiner

*Primary Examiner* — Sandra Brase
(74) *Attorney, Agent, or Firm* — Morgan, Lewis & Bockius LLP

(57) ABSTRACT

A charging device includes: a to-be-charged member; a charging member that charges the to-be-charged member and is opposed to the to-be-charged member; a cover member that surrounds the charging member disposed inside of the cover member but has an opening at a site opposed to the to-be-charged member; a grid electrode that is disposed on the opening side of the cover member with respect to the charging member, the grid electrode being provided between the cover member and the to-be-charged member; and a protective member that is provided along a longitudinal direction of the grid electrode, the protective member protecting an end part of the grid electrode and having at least one opening that is provided between the to-be-charged member and an end part of the cover member on the to-be-charged member side.

10 Claims, 6 Drawing Sheets

CHARGING DEVICE

CROSS-REFERENCE TO RELATED APPLICATION

This application is based on and claims priority under 35 USC 119 from Japanese Patent Application No. 2009-022860 filed Feb. 3, 2009.

BACKGROUND

1. Technical Field

The present invention relates to a charging device.

2. Related Art

As for the charging device conventionally used for an image forming apparatus, a corotron charging device of charging a photoreceptor drum in a non-contact manner is known.

SUMMARY

According to an aspect of the invention, there is provided a charging device, including:

a to-be-charged member;

a charging member that charges the to-be-charged member and is opposed to the to-be-charged member;

a cover member that surrounds the charging member disposed inside of the cover member but has an opening at a site opposed to the to-be-charged member;

a grid electrode that is disposed on the opening side of the cover member with respect to the charging member, the grid electrode being provided between the cover member and the to-be-charged member; and a protective member that is provided along a longitudinal direction of the grid electrode, the protective member protecting an end part of the grid electrode and having at least one opening that is provided between the to-be-charged member and an end part of the cover member on the to-be-charged member side.

BRIEF DESCRIPTION OF THE DRAWINGS

Exemplary embodiments of the present invention will be described in detail based on the following figures, wherein.

DETAILED DESCRIPTION

Figure 1:
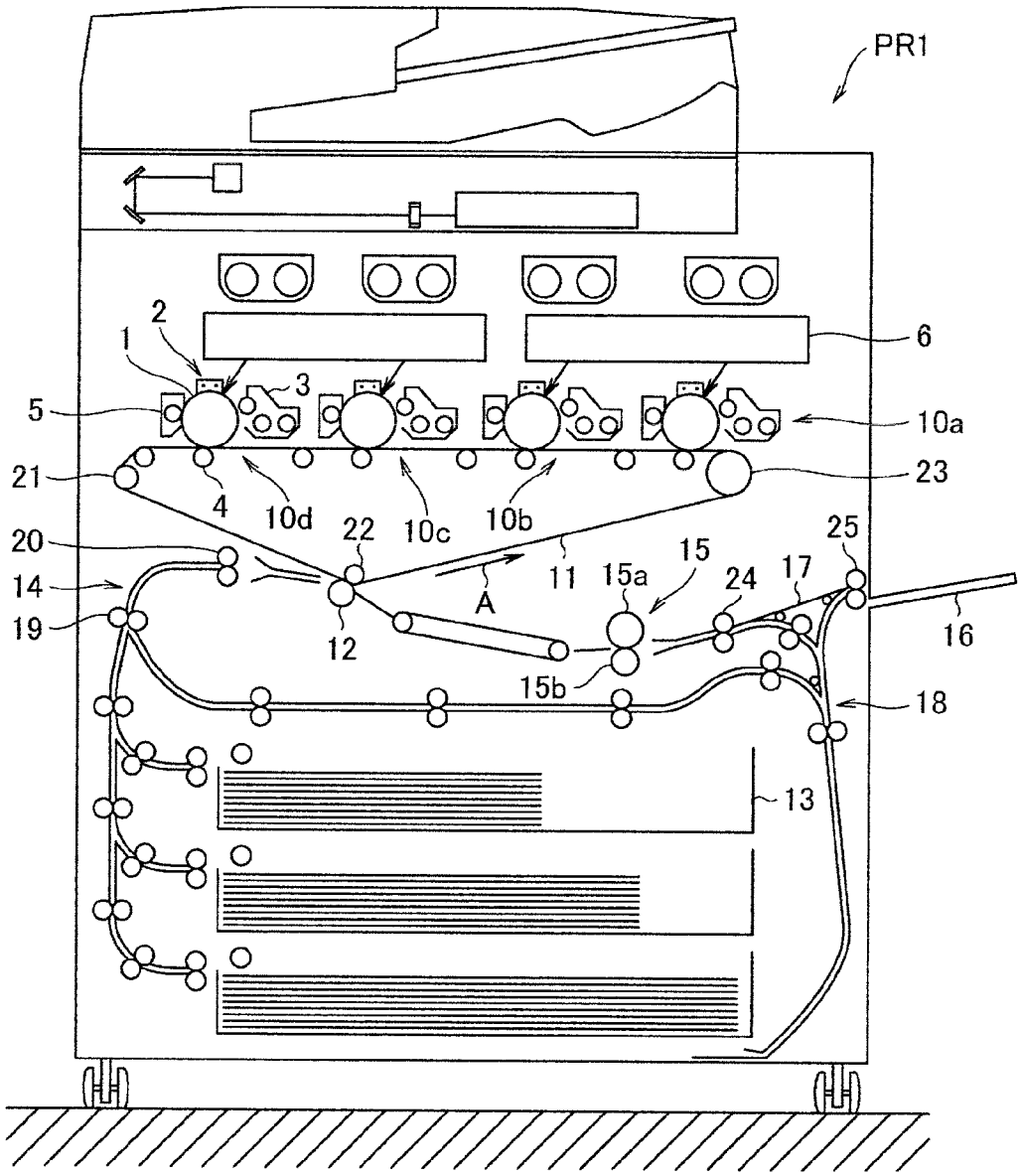
FIG. 1 represents a schematic construction view showing the construction of the image forming apparatus PR1 according to an exemplary embodiment.

Exemplary embodiments of the present invention are described in detail below based on the drawings by way of example. In the drawings, like reference numerals are used for like members and the overlapped description is omitted. Incidentally, the present invention is not limited to these embodiments.

An image forming apparatus PR1 according to an exemplary embodiment of the present invention is described by referring to FIGS. 1 to 6.

The image forming apparatus PR1 is a color printer and is equipped with a charging device 2 as one embodiment of the present invention.

The image forming apparatus PR1 is equipped with four image forming units 10*a*, 10*b*, 10*c* and 10*d* for forming yellow, magenta, cyan and black toner images, and an endless belt-like intermediate transfer material 11 is supported to oppose these image forming units 10*a* to 10*d* in the course of its circumferential surface moving in orbit.

On the downstream side of the position of the circumferential surface opposing the image forming unit in the moving direction, a transfer roller 12 for performing secondary transfer is disposed to oppose the intermediate transfer material 11, and a recording medium (e.g., printing paper) is fed to this secondary transfer part from a sheet tray 13 through a conveying path 14.

On the downstream side of the secondary transfer part in the recording medium conveying pathway, a fixing device 15 for press-fixing a toner image on the recording medium by heating/pressurizing the toner image is provided, and on the more downstream side, a paper discharge tray 16 for housing the recording medium having fixed thereon a toner image is provided.

A gate 17 is provided in the conveying pathway from the fixing device 15 to the paper discharge tray 16 and equipped with a double-side conveying path 18 for inverting front and back sides and again conveying the recording medium to the upstream side of the position of the transfer roller 12 being provided.

On the other hand, in the conveying path 14 reaching the secondary transfer part from the sheet tray 13, a conveying roller 19 for sandwiching a recording medium between two opposing rollers and conveying the recording medium along with rotational drive of the rollers is provided. Furthermore, on the upstream side of the secondary transfer part, a resist roller 20 for conveying a recording medium and at the same time, adjusting the timing of feeding the recording medium to the secondary transfer part is provided.

Figure 2:
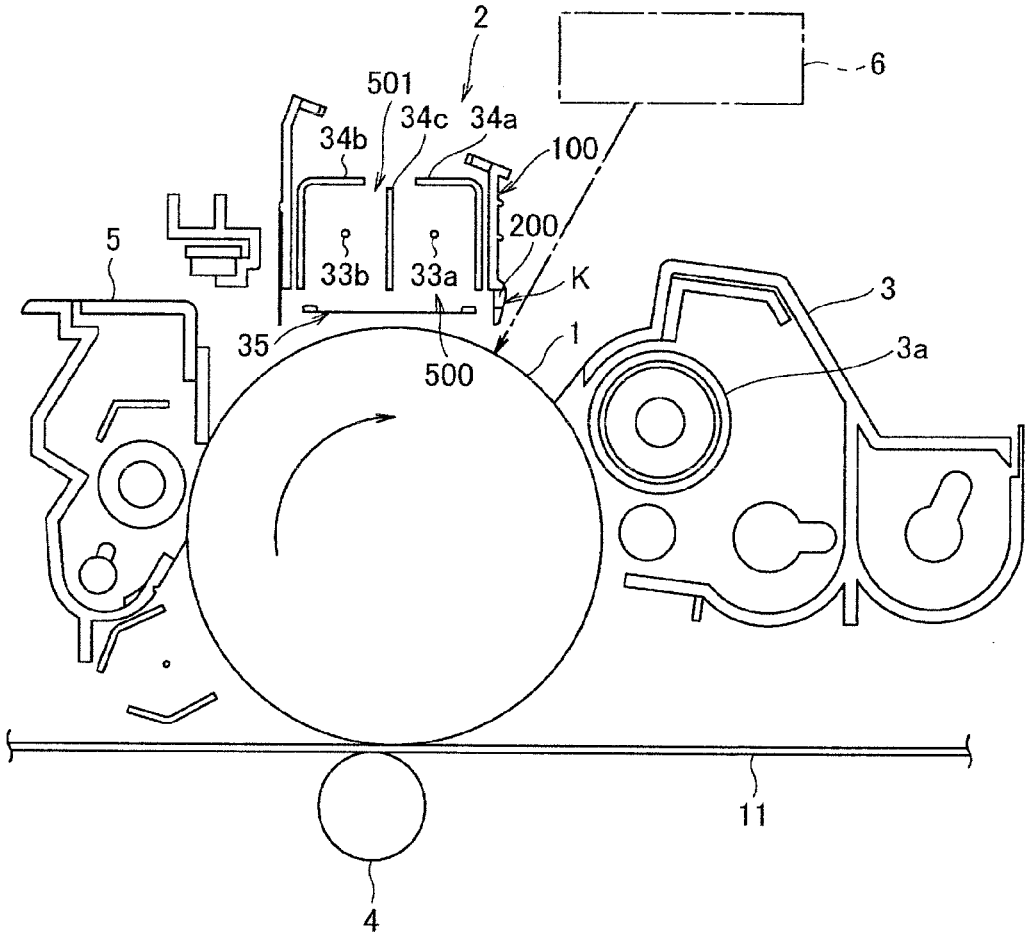
FIG. 2 represents a schematic construction view showing the construction of the charging device 2 of the image forming apparatus PR1 according to an exemplary embodiment.

As shown in FIG. 2, the image forming units 10*a*, 10*b*, 10*c* and 10*d* each has a photoreceptor drum 1 for forming an electrostatic latent image on the surface thereof, which is one example of the latent image holding member, and each photoreceptor drum 1 is equipped at its periphery with a charging device 2 for almost uniformly charging the surface of the photoreceptor drum, a developing device 3 for selectively transferring toner to a latent image formed on the photoreceptor drum to form a toner image, a transfer device 4 for causing the toner image on the photoreceptor drum 1 to be primarily transferred onto an intermediate transfer material 11, and a cleaning device 5 for collecting the toner remaining on the photoreceptor drum 1 after the transfer.

Furthermore, an image exposure device 6 for irradiating each of the uniformly charged photoreceptor drums 1 with image light based on image signals and writing an electrostatic latent image is provided.

It is also possible to employ a construction where a charging device 2, an image exposure device 6 and the like are integrally formed to fabricate an exposure unit and the exposure unit as a whole is, for example, incorporated into the apparatus or replaced.

The charging device 2 is equipped with two electrode wires 33*a* and 33*b* (one example of the charging member) tensioned at a predetermined distance from the circumferential surface of the photoreceptor drum 1 that is a to-be-charged element, and a voltage is applied between the electrode wire 33*a* or 33*b* and the photoreceptor drum 1 to cause corona discharge and thereby charge the surface of the photoreceptor drum 1.

The electrode wire is not limited to an exemplary embodiment of providing two electrode wires as in this exemplary embodiment, but only one electrode wire may be provided.

The detailed construction of this charging device 2 is described later.

The image exposure device 6 generates laser light blinking on and off based on image signals and scans the laser light in the main scanning direction (axis line direction) of each photoreceptor drum 1 by means of a polygon mirror, whereby an electrostatic latent image corresponding to each color image is formed on the surface of each photoreceptor drum 1.

In the developing device 3, a two-component developer containing a toner and a magnetic carrier is used as the developer, and the developer is conveyed in the state of being magnetically adsorbed to a developing roller 3*a* opposing the photoreceptor drum 1.

The developer layer on the developing roll is adjusted to an appropriate thickness by a regulating blade and supplied to the position opposing the photoreceptor drum 1. To the developing roller 3*a*, a developing bias voltage Vd (for example, −500 V) is applied for transferring the toner onto the electrostatic latent image on the photoreceptor drum 1.

Inside the intermediate transfer material 11, a drive roller 21, an opposing roller 22 and a support roller 23 are disposed, and the intermediate transfer material 11 is tensioned over these rollers and designed to move in orbit in the direction of arrow A shown in FIG. 1.

The transfer roller 12 is provided at the position opposing the opposing roller 22 and pressed against the opposing roller 22 through the intermediate transfer material 11.

The fixing device 15 is equipped with a heating roller 15*a* containing a heating source and a pressure roller 15*b* press-contacting with the heating roller 15*a*, and these rollers are disposed in parallel to form a nip part for sandwiching a recording medium.

The recording medium having transferred thereon the toner image is fed to the nip part and heated under pressure between the heating roller 15*a* and the pressure roller 15*b*, which are rotationally driven, and the melted toner is press-fixed on the recording medium.

In the conveying pathway on the downstream side of the fixing device 15, a recording medium-conveying roller 24 and a paper discharge roller 25 for delivering the recording medium to the paper discharge tray 16 are provided, and the gate 17 for switching the recording medium-conveying direction is provided between the conveying roller 24 and the paper discharge roller 25.

Details of the charging device 2 are described below by referring to FIGS. 2 to 6.

In the charging device 2, electrode wires 33*a* and 33*b* as one example of the charging member are tensioned between end members (not shown) each fixed and supported at a predetermined position with respect to the circumferential surface of the photoreceptor drum 1.

The electrode wires 33*a* and 33*b* are disposed to oppose the photoreceptor drum 1 in the state of being tensioned in the width direction of the endless circumferential surface of the photoreceptor drum and maintain a predetermined distance from the circumferential surface.

A sealed case 34 (one example of the cover member) with both ends being supported by end members on respective sides is provided and designed to surround the periphery along the electrode wires 33*a* and 33*b*.

Although not particularly limited, in this exemplary embodiment, the sealed case 34 is composed of a right-left pair of wall bodies 34*a* and 34*b* and a partitioning member 34*c* for partitioning the electrode wires 33*a* and 33*b*.

As shown in FIG. 2, the portion where the sealed case 34 opposes the circumferential surface of the photoreceptor drum 1 is opened, and in this portion, a grid 35 which is one example of the netted grid electrode for controlling the electric field formed by the electrode wires 33*a* and 33*b* as charging members is provided, with both end parts being supported by the end members.

The netted grid 35 is preferably thin for reducing the electric charge loss and is preferably formed on a bend-free thin plate for enhancing the flatness.

A voltage for charging is applied to the electrode wires 33*a* and 33*b* to form an electric field between the electrode wire and the photoreceptor drum 1, and the grid 35 is set to a potential between the potential of the electrode wires 33*a* and 33*b* and the potential of the photoreceptor drum 1 and controls the electric field so that the surface of the photoreceptor drum 1 can be charged to an almost predetermined potential.

Incidentally, in this charging device 2, electrode wires 33*a* and 33*b* are used as the charging member, but the charging member is not limited to a wire, and a pin discharge system such as pin electrode type and sharp-pointed electrode type, or a discharge system using a bar-like member may also be applied.

Figure 4:
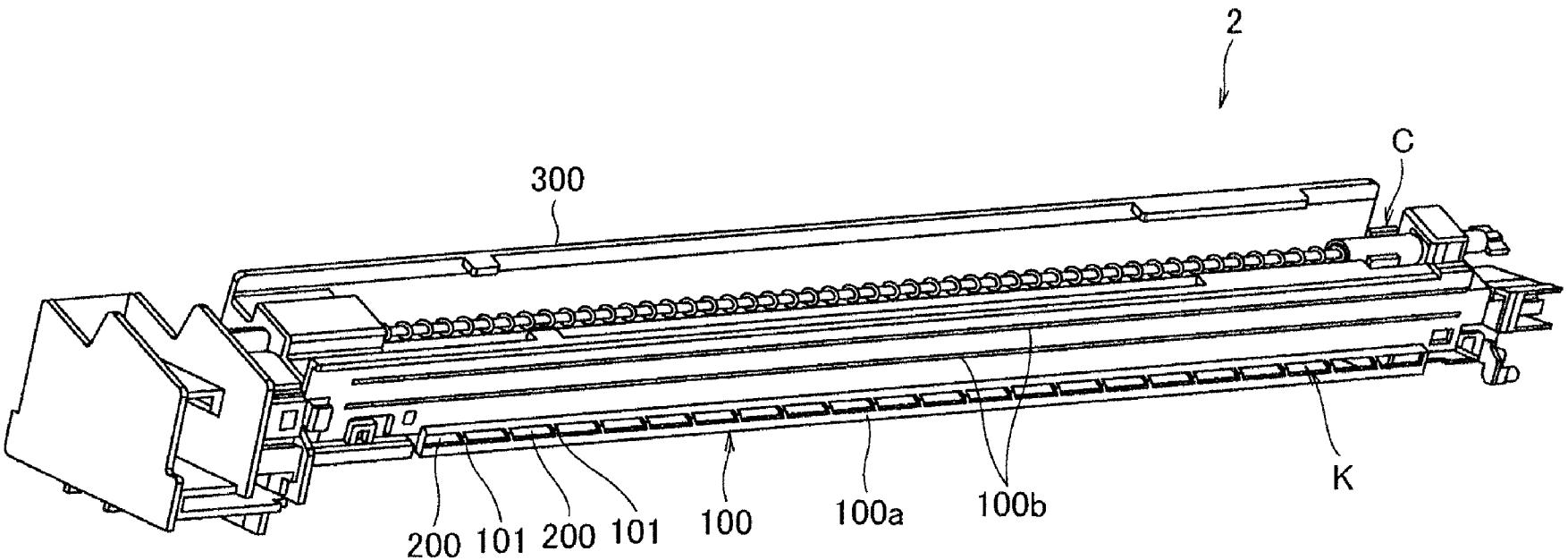
FIG. 4 represents a perspective view showing the appearance of the charging device 2 of the image forming apparatus PR1 according to an exemplary embodiment.
Figure 5:
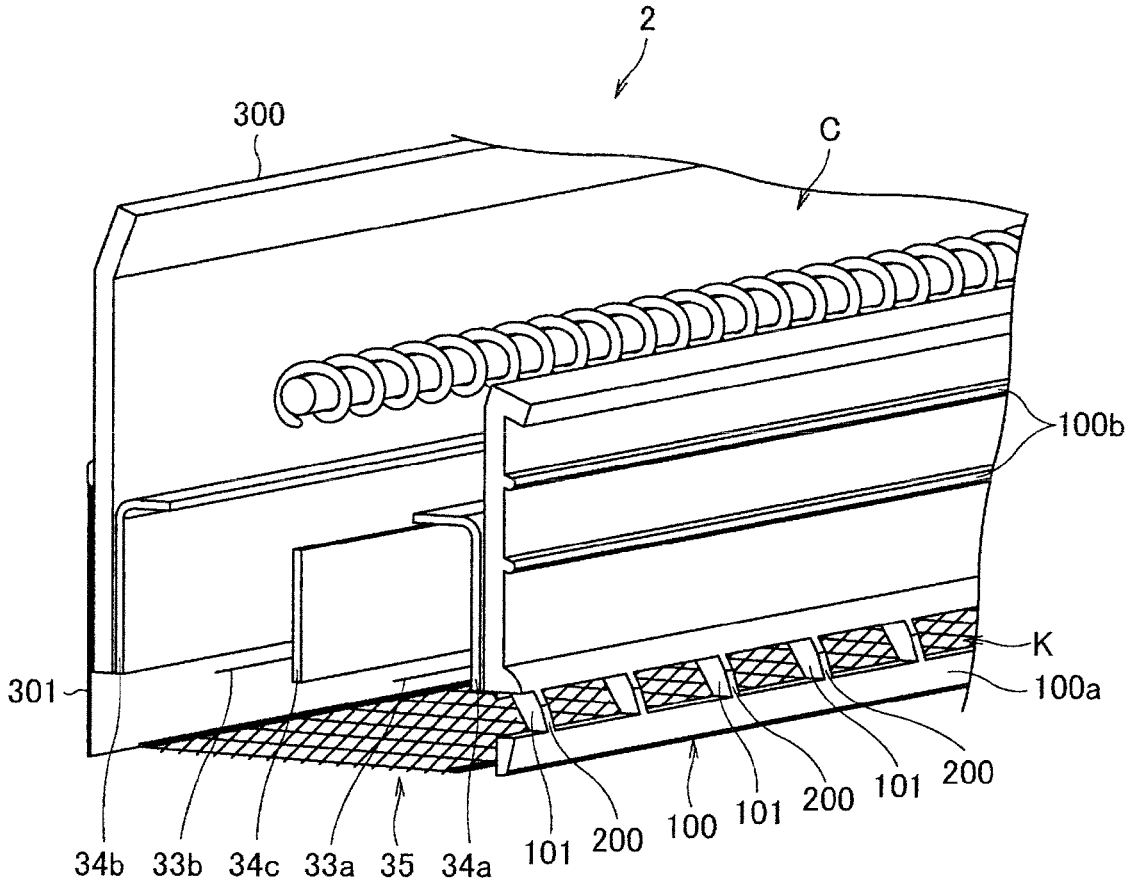
FIG. 5 represents a cross-sectional perspective view showing the construction of the charging device 2 of the image forming apparatus PR1 according to an exemplary embodiment.

Also, as shown in FIGS. 4 and 5, the charging device 2 is equipped with a cleaning mechanism C for the electrode wires 33*a* and 33*b*, but this mechanism is irrelevant to the present invention and its description is omitted.

The front opening 500 is an opening of the sealed case 34 which is positioned in the side of the photoreceptor drum 1 seen from the electrode wires 33*a* and 33*b*. The back opening 501 is an opening of the sealed case 34 which is positioned in the opposite side of the photoreceptor drum 1 seen from the electrode wires 33*a* and 33*b*.

Figure 3:
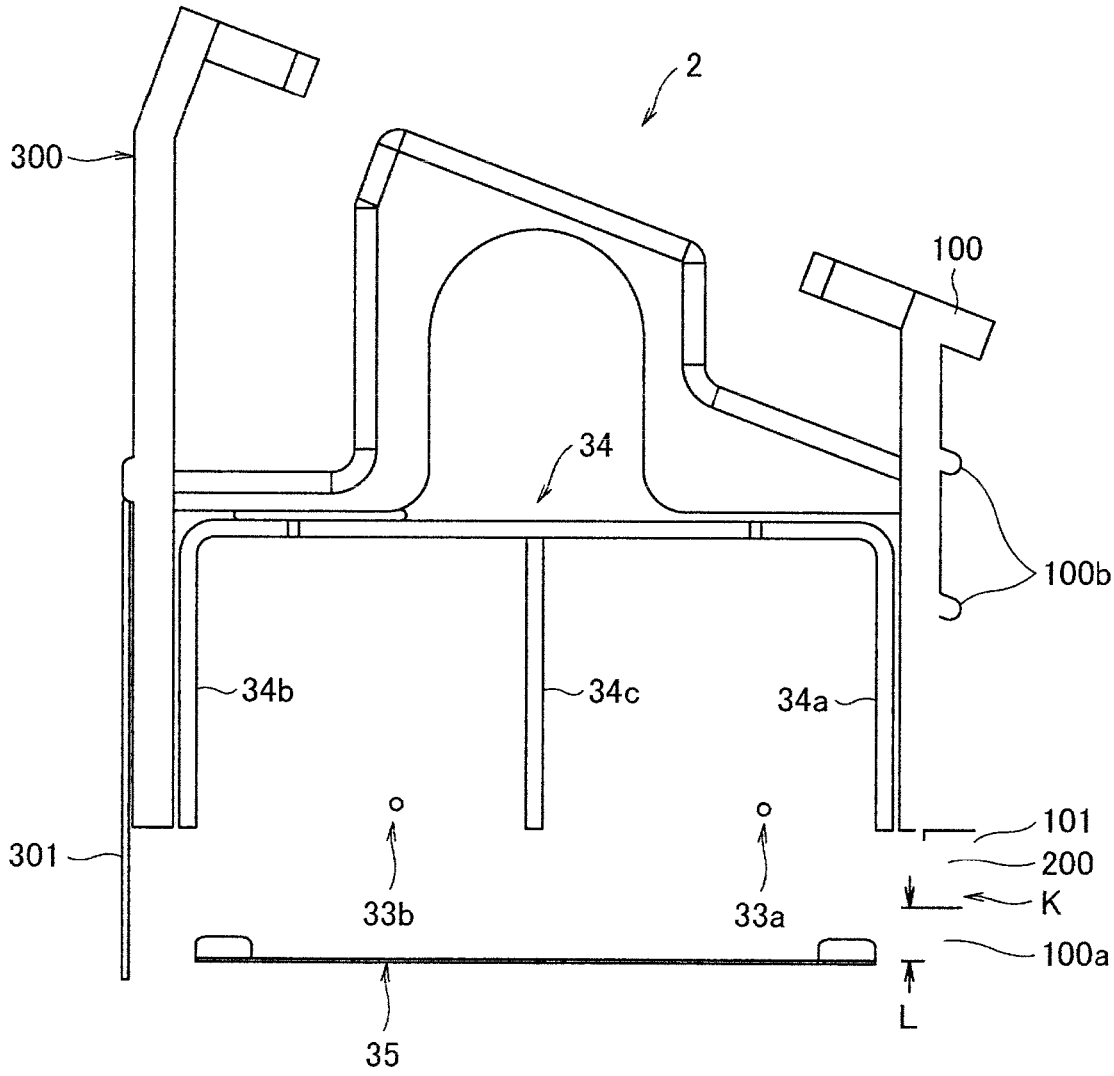
FIG. 3 represents a side cross-sectional view showing the construction of the charging device 2 of the image forming apparatus PR1 according to an exemplary embodiment.

In the exemplary example shown in FIG. 3, on the left side of the sealed case 34, wall members 300 and 301 covering the side surface of the wall body 34*b* are disposed upright.

On the right side of the sealed case 34, a protective member 100 covering the side surface of the wall body 34*a* and the end part of the netted grid 35 is disposed upright.

Although not particularly limited, the wall member 300 and the protective member 100 are preferably formed of a resin.

By virtue of the construction above, even when a worker comes into contact with the neighborhood of the netted grid 35 at the maintenance work or the like of the charging device 2, the end part of the netted grid 35, which is protected by the protective member 100, can be prevented from denting or breakage.

In the protective member 100, an air-discharge opening K allowing ionic wind and airflow flowing from the electrode wire 33*a* or 33*b* side to pass through is formed along the longitudinal direction (see FIGS. 4 and 5).

By virtue of this construction, even when a protective member 100 is provided to reduce the damage of the grid 35, the ionic wind and airflow can be discharged to the outside of the sealed case through the air-discharge opening K.

Here, when envisaging a charging device in an image forming apparatus, the easy flowing of air changes between an opening and a non-opening part and the flowing of air (flow of air) in the axial direction becomes non-uniform in the vicinity of the grid electrode, as a result, image density unevenness is generated. Also, the discharge product adhering to the discharge wire becomes non-uniform in the axial direction and this gives rise to more marked image density unevenness.

On the other hand, according to this exemplary embodiment, the ionic wind and airflow are discharged to the outside though the opening 200 as an air-discharge part K, so that generation of image density unevenness can be prevented. Furthermore, since the end part of the netted grid 35 is protected by the protective member 100, breakage and the like can be prevented from occurring.

In this exemplary embodiment, the air-discharge part K is formed by an opening 200, that is, as shown in FIGS. 4 and 5, by a plurality of openings 200 juxtaposed through ribs 101 in the height direction provided in the protective member 100.

Incidentally, in the case where sufficient strength can be maintained even without providing a rib 101, the number of ribs 101 may be decreased or the rib may be omitted.

As the number of ribs 101 is smaller, the number of structures disturbing the flow of ionic wind and air is decreased, which is advantageous in that reduction of air velocity is prevented and the ionic wind and airflow are more smoothly discharged.

Also, as shown in FIG. 3, an opening is not provided at the position of the protective member 100 intersecting with an extended line of the netted grid 35. At the position of the protective member 100 intersecting with an extended line of the netted grid 35, the lower end part 100*a* of the protective member 100 protects the end part of the netted grid 35.

In this exemplary embodiment, an opening is provided at a position 2 mm or more or about 2 mm or more distant in the height direction L from the position of the protective member 100 intersecting with an extended line of the netted grid 35.

By virtue of this construction, the effect of airflow passing through the opening 200 on the end part of the grid 35 can be reduced and the grid 35 can be decreased in the vibration due to airflow that is non-uniform in the axial direction. It is designed to contain the opening at least in the image region.

Also, in the longitudinal direction of the protective member 100, the rib 101 may be designed not to be provided at a position corresponding to the image forming region of the photoreceptor drum 1.

By virtue of this construction, the ionic wind and airflow in the longitudinal direction near the netted grid 35, which cause density unevenness, can be reduced in the unevenness in the longitudinal direction and the image quality can be enhanced.

Figure 6:
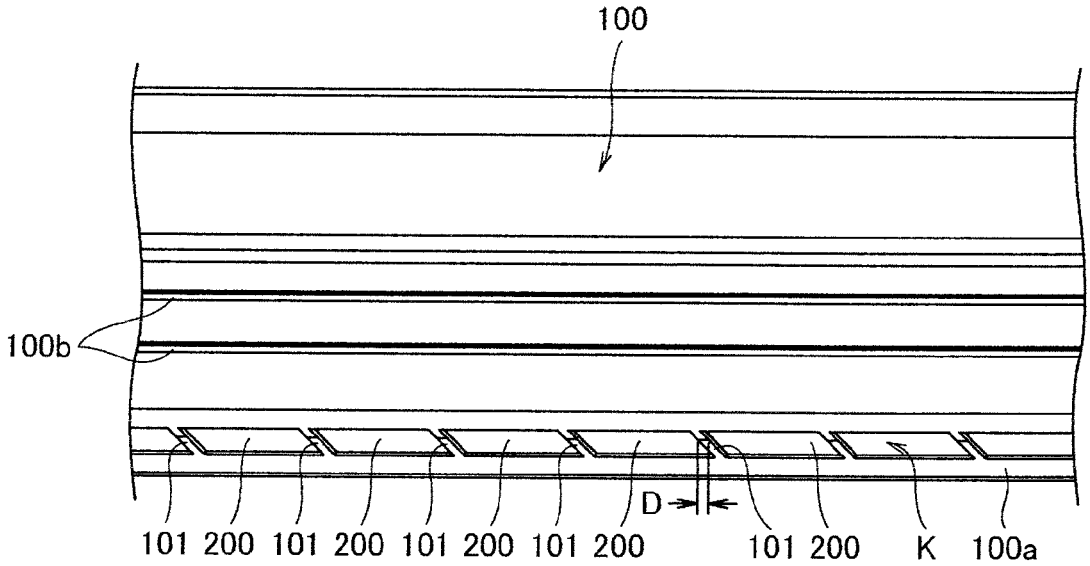
FIG. 6 represents a front view showing a construction example of the protective member 100.

Furthermore, as shown in FIG. 6, a part of the plurality of ribs 101 provided in the protective member 100 may be constructed such that openings 200 lying side-by-side through a rib 101 overlap each other along the longitudinal direction of the protective member 100.

That is, in the exemplary example shown in FIG. 6, each opening 200 is formed in a parallelogram shape and openings 200 lying side-by-side through a rib 101 come to overlap by a distance D in the longitudinal direction.

By virtue of this construction, even when a plurality of ribs 101 are provided in the opening 200 along the longitudinal direction of the protective member 100, a region where an opening is not provided can be eliminated from before and behind the rib 101 and the airflow in the axial direction can be prevented from unevenness in the longitudinal direction of the protective member, as a result, the density unevenness is reduced and the image quality is enhanced.

Although the invention accomplished by the present inventors have been specifically described with respect to the embodiments thereof, the embodiments disclosed in the specification are exemplary only in all respects and the present invention should not be construed as being limited to these techniques disclosed. That is, the technical scope of the present invention should not be interpreted limitatively based on the description in those embodiments but should be interpreted in accordance with the description in claims and includes techniques equivalent to the techniques set forth in claims and all modifications within the scope of claim for patent.

For example, in the exemplary embodiment above, the protective member 100 covering the end part of the netted grid 35 is provided only on one side of the sealed case 34, but according to the position or the like where the charging device is installed, the protective member 100 covering the end part of the netted grid 35 may be provided on both sides of the sealed case 34.

By virtue of this construction, even when a worker comes into contact with the neighborhood of the netted grid 35 at the maintenance work or the like of the charging device, both end parts of the netted grid 35, which are protected by a protective member 100, can be prevented from denting or breakage.

The charging device, exposure unit and image forming apparatus of the present invention can be applied to a copying machine, a laser printer, a full color printer, a complex machine, a facsimile machine and the like.

Also, in the exemplary embodiments above, a case of using the charging device for an image forming apparatus is described, but the charging device can also be used as a charging device for laminating a protective film to a metal plate surface or can be applied to a charge eliminating device of eliminating an electric charge from a protective member by using corona discharge when winding a thin-film protective member around a component or a device.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A charging device, comprising:

a to-be-charged member;

a charging member that charges the to-be-charged member and is opposed to the to-be-charged member;

a cover member that surrounds the charging member disposed inside of the cover member but has an opening at a site opposed to the to-be-charged member;

a grid electrode that is disposed on the opening side of the cover member with respect to the charging member, the grid electrode being provided between the cover member and the to-be-charged member; and a protective member that is provided along a longitudinal direction of the grid electrode, the protective member protecting an end part of the grid electrode and having at least one opening that is provided between the to-be-charged member and an end part of the cover member on the to-be-charged member side, wherein the protective member has a plurality of openings juxtaposed through a plurality of ribs, and at least a part of the plurality of ribs are provided such that openings adjacent to the rib overlap each other when the protective member is cut in a cross-section perpendicular to a longitudinal direction of the protective member.

2. The charging device according to claim 1, wherein the protective member does not have the at least one opening at a position of the protective member intersecting with an extended line of the grid electrode.

3. The charging device according to claim 2, wherein the at least one opening is provided at a position about 2 mm or more distant in a direction perpendicular to a longitudinal direction of the protective member from the position of the protective member intersecting with the extended line of the grid electrode.

4. The charging device according to claim 1, wherein the cover member further comprises a partition member, the partition member being set to separate the charging member.

5. The charging device according to claim 4, wherein the cover member further comprises a back opening that is opposite the opening at a site opposed to the to-be-charged member, the back opening being formed by the partition member and other parts of the cover member.

6. A charging device, comprising:

a to-be-charged member;

a charging member that charges the to-be-charged member and is opposed to the to-be-charged member;

a cover member that surrounds the charging member disposed inside of the cover member but has an opening at a site opposed to the to-be-charged member;

a grid electrode that is disposed on the opening side of the cover member with respect to the charging member, the grid electrode being provided between the cover member and the to-be-charged member; and a protective member that is provided along a longitudinal direction of the grid electrode, the protective member protecting an end part of the grid electrode and having at least one opening which an air inside of the cover member passes through, wherein the protective member has a plurality of openings juxtaposed through a plurality of ribs, and at least a part of the plurality of ribs are provided such that openings adjacent to the rib overlap each other when the protective member is cut in a cross-section perpendicular to a longitudinal direction of the protective member.

7. The charging device according to claim 6, wherein the protective member does not have the at least one opening at a position of the protective member intersecting with an extended line of the grid electrode.

8. The charging device according to claim 7, wherein the at least one opening is provided at a position about 2 mm or more distant in a direction perpendicular to a longitudinal direction of the protective member from the position of the protective member intersecting with the extended line of the grid electrode.

9. The charging device according to claim 6, wherein the cover member further comprises a partition member, the partition member being set to separate the charging member.

10. The charging device according to claim 9, wherein the cover member further comprises a back opening that is opposite the opening at a site opposed to the to-be-charged member, the back opening being formed by the partition member and other parts of the cover member.

* * * * *